US008218987B2

(12) United States Patent
Strossman et al.

(10) Patent No.: US 8,218,987 B2
(45) Date of Patent: Jul. 10, 2012

(54) SYSTEMS AND METHODS FOR TANDEM PRINTING AND PRINT JOB SCHEDULING

(75) Inventors: John A. Strossman, Webster, NY (US); Aaron M. Sanders, Fairpoint, NY (US); Steven G. Service, Rochester, NY (US); Gregg A. Bonikowski, Rochester, NY (US); Ronald W. Bogert, Webster, NY (US); Donald James Van Tyne, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 12/366,223

(22) Filed: Feb. 5, 2009

(65) Prior Publication Data

US 2010/0196027 A1 Aug. 5, 2010

(51) Int. Cl.
*G03G 15/00* (2006.01)

(52) U.S. Cl. ..... 399/45; 399/68; 399/400

(58) Field of Classification Search ..... 399/45, 399/68, 400

See application file for complete search history.

(56) References Cited

U.S. PATENT DOCUMENTS 5,436,711 A 7/1995 Hauser
2007/0071465 A1 * 3/2007 Hamby et al. ..... 399/45

OTHER PUBLICATIONS

David R. Kamprath et al.; U.S. Appl. No. 12/183,705, filed Jul. 31, 2008.

* cited by examiner

*Primary Examiner* — Ryan Walsh
(74) *Attorney, Agent, or Firm* — Ronald E. Prass, Jr.; Prass LLP

(57) ABSTRACT

According to aspects of the embodiments, there is provided a printing system that includes first and second marking devices for applying images to print media. A first fusing module associated with the first marking device for applying a primary fusing treatment to the images applied to print media by the first marking device. A second fusing module which receives printed media from the first and second marking devices, the secondary fusing module including a fusing device that applies a fusing treatment to the images applied to the printed media. A printing controller having a scheduler for processing print jobs in the first and second marking devices based on fusing requirements of the print media.

14 Claims, 5 Drawing Sheets

SYSTEMS AND METHODS FOR TANDEM PRINTING AND PRINT JOB SCHEDULING

BACKGROUND

This disclosure relates in general to copier/printers, and more particularly, to printing systems with multiple processing units providing substantial degrees of freedom in performing print jobs, and to print job scheduling for such printing systems.

Certain stocks, in particular heavyweight coated stocks, have greater fusing requirements than the majority of stocks. Current print systems when processing heavyweight coated stocks handle the greater fusing requirements is by increasing fuser temperature or by maintaining a constant fuser temperature for all stocks but reducing the process speed for heavyweight stock so as to provide increased fuser dwell time. These approaches are not ideal and require trade offs between equipment life and print process delays. Selective increases in fuser temperature leads to reduce fuser roll life and higher service costs, and print process delays with system productivity reduction while warming the fuser to prepare for difficult stocks. While a reduction in process speed reduces overall printer productivity by virtue of a slower speed through the fuser.

Adding to process delays, printing systems have generally employed only one or a few sheet paths, and only one or a few print job destinations. For example, a typical printing system may have a single printer or marking engine, which bottlenecks sheet processing down to a single print path. Even if multiple marking engines are provided, a print media conveyor may be configured to limit sheet processing to a single print path. In such an arrangement, the print jobs are queued and performed sequentially, in a first-in-first-out (FIFO) sequence. Some more advanced printing systems provide multiple sheet paths and multiple job destinations through concepts such as tandem printing or cluster printing when three or more printing systems are combined. In advanced multiple printing systems, the printing process is managed through a job scheduler that divides the sheets of a given print job amongst two or more of the linked printing systems. Each printing system of a multiple printing system is an independent printing system. There is a tendency to treat the greater fusing requirements as an issue handle by each individual machine.

For the reasons stated above, and for other reasons stated below which will become apparent to those skilled in the art upon reading and understanding the present specification, there is a need in the art for processing of print jobs with stock having greater fusing requirements.

SUMMARY

According to aspects of the embodiments, there is provided a printing system that includes first and second marking devices for applying images to print media. A first fusing module associated with the first marking device for applying a primary fusing treatment to the images applied to print media by the first marking device. A second fusing module which receives printed media from the first and second marking devices, the secondary fusing module including a fusing device that applies a fusing treatment to the images applied to the printed media. A printing controller having a scheduler for processing print jobs in the first and second marking devices based on fusing requirements of the print media.

DETAILED DESCRIPTION

Figure 1:
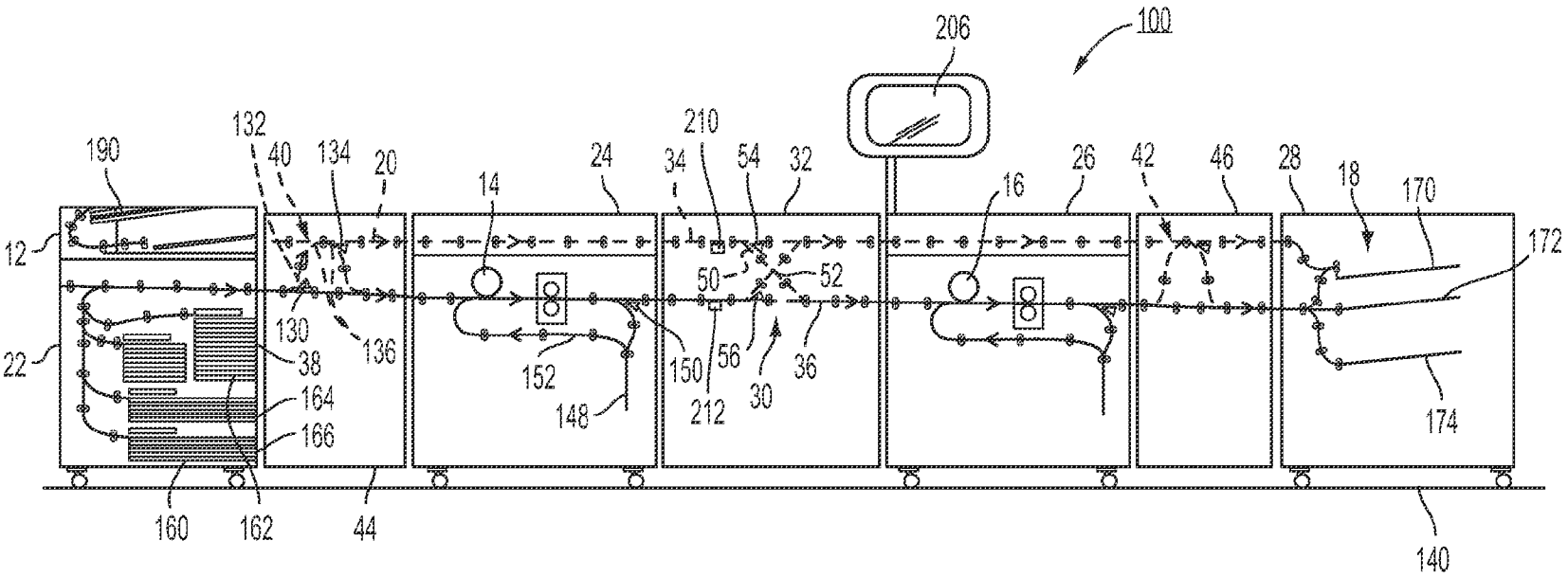
FIG. 1 is a schematic view of a tandem printing system incorporating a media path crossover in accordance to an embodiment.

Aspects of the disclosed embodiments relate to an apparatus and method to reduce/eliminate skipped pitches for mixed substrate jobs. The proposed method for a tandem system would use one system to make the heavy weight sheets of the job while using the remaining system to provide normal basis weight printing. System one could be used to make the heavy weight inserts, and serve them to the second system as needed. No skipped pitches would be required during paper throughput.

The disclosed embodiments include a tandem printing system comprising a first and second printer, each of said printers having a sheet feeder, a sheet transport, a device for printing images onto sheets supplied from said sheet transport by said sheet feeder, a fuser for fusing said images placed onto the sheets. The tandem printing system includes a printing controller having a scheduler for processing print jobs in the first and second printers. The scheduler in the controller schedules based on at least one parameter of the sheet such as paperweight.

The disclosed embodiments further include a printing system having first and second marking devices for applying images to print media. A first fusing module associated with the first marking device for applying a primary fusing treatment to the images applied to print media by the first marking device. A second fusing module which receives printed media from the first and second marking devices, the secondary fusing module including a fusing device which applies a fusing treatment to the images applied to the printed media. A printing controller having a scheduler for processing print jobs in the first and second marking devices based on fusing requirements, wherein the fusing requirements based on at least one parameter of the print media. The disclosed embodiments further include a method for scheduling a print job in accordance with a job specification in a tandem print system by performing the steps of receiving the job specification for processing at the tandem print system, wherein the job specification includes at least one sheet parameter. The tandem print system produces a command stream from the job specification to produce the job using the tandem print system. The produced command stream causes all sheets that exceed a predetermined paperweight to be printed on a first printer of the tandem print system.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof) to a computer, the computer properly views the connection as a computer-readable medium. Thus, any such connection is properly termed a computer-readable medium. Combinations of the above should also be included within the scope of the computer-readable media.

The term "marking engine" is used herein generally to refer to a device for applying an image to print media. The term "print media" generally refers to a usually flexible, sometimes curled, physical sheet of paper, plastic, or other suitable physical print media substrate for images, whether precut or web fed.

The term "printing system" as used herein refers to a digital copier or printer, bookmaking machine, facsimile machine, multi-function machine, or the like and can include several marking engines, as well as other print media processing units, such as paper feeders, finishers, and the like. The term "Print job" or "document" can include a plurality of digital pages or electronic pages to be rendered as one or more copies on a set of associated sheets of print media, each page, when rendered constituting the front or backside of a sheet. The pages of a print job may arrive from a common source and, when rendered, be assembled at a common output destination.

The term "tandem printing system" generally includes two or more marking engines of varying print modalities. For example, black only (K) print modality, process color (P) print modality, custom color (C) print modality, black and white (b/w) print modality, or full-color print modality that can be used interchangeably for at least some of the print jobs or portions thereof that are handled by the printing system. The tandem printing system may be configured for parallel printing such that portions of a print job may be distributed among two or more marking engines of the same print modality and then assembled as a single document or such that several print jobs may be distributed among the marking engines whereby two or more print jobs may be printed contemporaneously. Additionally or alternatively, the tandem printing system may be configured for printing opposite sides of a sheet on different marking engines (tandem duplex printing).

FIG. 1 illustrates an exemplary printing arrangement 100 with tandem printing system capable of incorporating a combination of printers, copiers, or multifunction device having both printing and copying capabilities. The tandem printing system 140 is ideal for mixed media print jobs since it allows the operator to separate the printing based on the type of media, in such a scheme one part of the system is used for a first media type while the remaining system is used for a second media type. Tandem printing system 140 is a modular system and includes a plurality of print media processing units, such as a print media source 12, a plurality of marking engines 14, 16, and an output destination 18, such as a finisher. The processing units 12, 14, 16, and 18 are all interconnected by a print media conveyor system 20.

In some embodiments, one or more of the print media processing units are modular and are housed in a respective housing 22, 24, 26, and 28. The modules may be interconnectable and interchangeable to allow printing system 100 to be reconfigured so to include fewer or more print media processing units. In some embodiments, one or more of the processing units 12, 14, 16, 18 are removable processing units. For example, the functional portion of a processing unit may be removed, leaving only the external housing 22, 24, 26, 28 or mounting fixture through which the print media conveyor 20 passes. In this manner, for example, the functional portion can be removed for repair, or can be replaced to make an upgrade or modification at printing system 100.

The printing system 100 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by printing system 100 are determined by the capabilities of the paper source 12, marking engines 14, 16, and finisher 18 of the printing system 100. These capabilities may increase over time due to addition of new processing units or upgrading of existing processing units. The capabilities may also decrease over time due to failure or removal of one or more processing units.

The conveyor system 20 includes a media path crossover 30, which may be in the form of a separate module which is housed in its own housing 32, as shown, or may be incorporated into one or more of the other processing modules. In the illustrated embodiment, the media path crossover 30 connects parallel downstream main pathways 34, 36 of the conveyor system 20. Pathway 34 is a bypass pathway which conveys sheets 38 of print media between the print media source 12 and the output destination. The pathway 34 bypasses both marking engines (14, 16) . . . Pathway 36 conveys sheets of print media from the first marking engine 14 to the second marking engine 16, e.g., for tandem duplex printing (where marking engines 14 and 16 print on opposite sides of the same sheet) or for overprinting (both marking engines 14 and 16 print on the same side of the sheet). Pathway 36 may also interconnect the first marking engine 14 with the paper source 12 and the second marking engine 16 with the output destination 18.

Sheets 38 of print media are conveyed between the pathways 34, 36 for selective direction of the sheets to one or other of the marking engines 14, 16. In the illustrated embodiment, sheets are transferred between the main pathways 34, 36 via the media path crossover 30, at a location which is intermediate the first and second marking engines 14, 16. Sheets can also be transferred between the pathways 34, 36 in first and second bell modules 40, 42 located upstream of the first marking engine 14 and downstream of the second marking engine 16, respectively. The bell modules 40, 42 may be housed in respective housings 44, 46, and be replaceable and/or interchangeable conveyor modules of printing system 100, as for the crossover module 30. In the illustrated embodiment, the bell modules 40, 42 space the marking engines 14, 16 from the print media source 12 and output destination 18, respectively. It is to be appreciated that the printing system may include additional conveyor modules to those illustrated.

Figure 2:
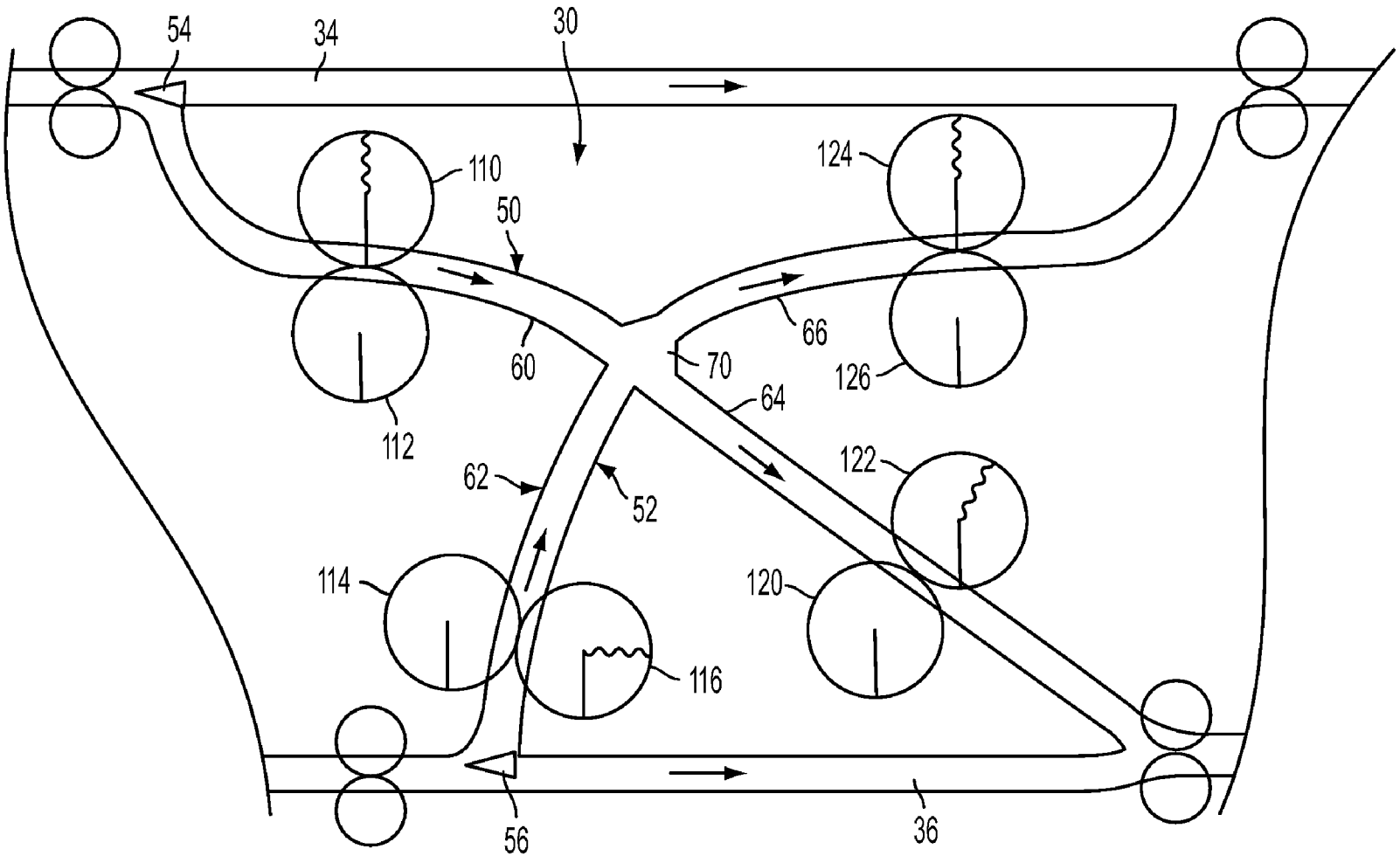
FIG. 2 is an enlarged cross sectional view of the media path crossover of FIG. 1 in accordance to an embodiment.

FIG. 2 illustrates the media path crossover 30 includes two intersecting pathways: a first crossover pathway 50 and a second crossover pathway 52, which crosses pathway 50. Ends of the pathways 50, 52 connect main pathways 34 and 36. In the embodiment of FIG. 1, pathway 50 conveys sheets of print media between pathways 34 and 36 such that print media which has bypassed marking engine 14 can be directed to marking engine 16 for marking. Similarly, pathway 52 conveys print media between pathways 36 and 34 such that print media which has been marked by marking engine 14 can bypass marking engine 16. In this way, the printing system 100 can be used for simplex printing or single engine duplex printing, in which the outputs of the two marking engines 14,16 are combined to enable an increase in productivity of the printing system 100 over that of a single marking engine. When operated in a simplex printing mode, for example, a portion (typically half) of the sheets of a print job to be printed are transported via pathway 36 to marking engine 14 and are thereafter transferred from pathway 36 to pathway 34 at the media path crossover 30, thereby bypassing the second marking engine 16. A second portion (typically the remainder of the print job) is directed to marking engine 16. Sheets to be marked bypass marking engine 14 and then crossover from pathway 34 to pathway 36 via crossover 30. The two portions are subsequently combined in output order, for example, by merging the output of marking engine 14 into pathway 36 in the bell module 42, downstream of marking engine 16.

It is to be appreciated, that the media path crossover 30 may include more than two intersecting pathways. It is also contemplated that printing system 100 may include more than one media path crossover 30. For example, a printing system which incorporates more than two marking engines may have additional media path crossovers. Additionally or alternatively, media path crossovers may be provided upstream of both marking engines 14, 16 and/or downstream of both marking engines, such as in the locations of the bell modules 40, 42. With continued reference to FIGS. 1 and 2, the print media sheets may be directed from respective pathways 34, 36 into pathways 50, 52 by selectable decision gates 54, 56. The decision gates 54, 56 each have a first position, in which the print media continues on the main pathway 34, 36, respectively, and a second position, in which the print media is directed into the media path crossover 30.

With reference to FIG. 2 pathways 50 52 of the illustrated media path crossover 30 each include an inlet path 60, 62 and an outlet path 64, 66, respectively. The pathways 50, 52 cross at a four way junction 70, which connects inlet path 60 with outlet path 64 and inlet path 62, with outlet path 64. The illustrated junction 70 is configured such that sheets entering from inlet path 60 are steered toward outlet path 64 and sheets entering from inlet path 62 are steered toward outlet path 66. In general, sheets from path 60 are directed away from outlet path 66 and away from inlet path 62, such that the sheets continue along pathway 50. Similarly, sheets from path 62 are directed away from outlet path 64 and away from inlet path 60, such that the sheets continue along pathway 52.

In the simplex mode, the decision gates 54, 56 can be set in the position to direct all the print media to the crossover 30 for an entire print job or jobs to be simplex printed. In this way, successive sheets traverse the junction from either direction without interruption by a gate. Similarly, in the tandem duplex mode, the gate 56 is set such that all the print media of a print job is directed along main pathway 36, without interruption by a gate.

Figure 3:
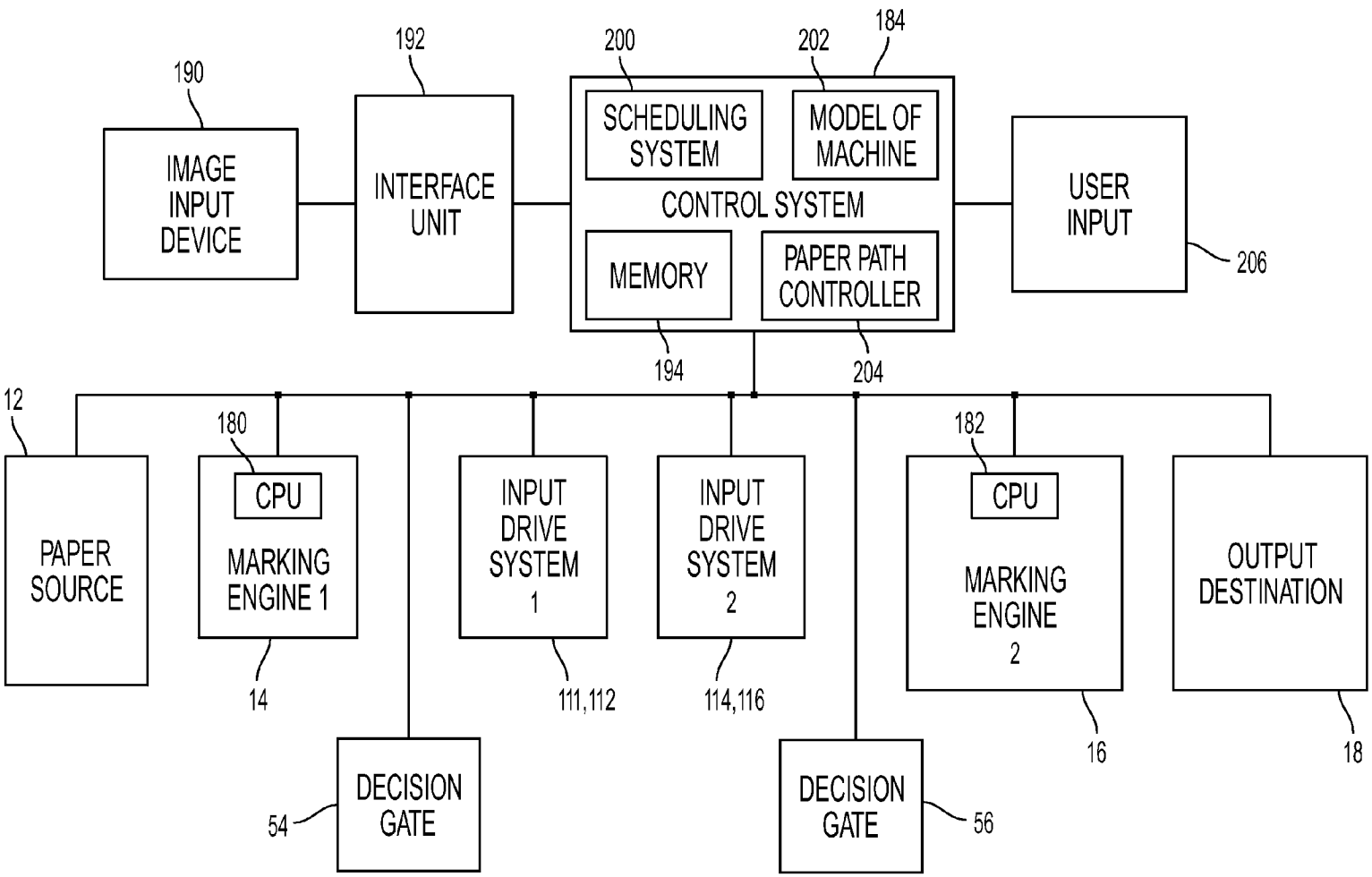
FIG. 3 is a block diagram of the printing system illustrating an exemplary control system in accordance to an embodiment.

FIG. 3 illustrates the processing component for printing system 100 shown in FIG. 1. The processing component is distributed over printing system 100 and includes a marking engine controller 180, 182 such as a CPU, associated with each marking engine 14, 16, which includes actuators for controlling each of the subsystems, and an overall control system 184, which communicates with the individual marking engine CPUs 180, 182. The marking engine controller 180, 182 is linked to the system controller 184 and may be also linked to other known components, such as a memory, a marking cartridge platform, a marking driver, a function switch, a self-diagnostic unit, all of which can be interconnected by a data/control bus. Each marking engine 14, 16 may have its own marking engine controller 180, 182.

An image input device 190 supplies printing system 100 with images to be printed. The image input device can comprise a built-in optical scanner, which can be used to scan a document such as book pages, a stack of printed pages, or the like, to create a digital image of the scanned document or electronic document that is reproduced by printing operations performed by the printing system 100. Alternatively, or additionally, a print job can be electronically delivered to printing system 100 via a wired or wireless connection to a digital network that interconnects, for example, personal computers (not shown) or other digital devices. The printing system optionally includes an interface unit 192, in communication with the control system 184, which converts the digital images and associated instructions into a form which can be utilized by the printing system 100. The interface unit 192 may identify the image to be associated with each sheet of the print job to be printed using information stored in a file header associated with the print job. The image content for each page may be stored as a bitmap in memory 194, to be delivered to the appropriate marking engine to which the page is later assigned for printing.

The control system 184 includes a scheduling system 200 that schedules the order of printing of incoming print jobs and identifies a marking engine or marking engines for printing each of the pages of the print job. The scheduling system 200 invokes a model of machine 202 to obtain information on the printing system and the capabilities of other components that are coupled to machine 202 for scheduling jobs. Additionally, the invoked model comprises a model of at least one parameter of the sheet such as paper weight. Certain stocks, in particular heavyweight coated stocks, have greater fusing requirements than the majority of stocks while certain printing modalities such as black and white require less fusing energy. The scheduler takes advantage of the dual fusers available in tandem printing systems to achieve an increased fuser dwell time by maintaining an increase in fuser temperature with a reduction in process speed without the negative impacts of either increased fuser temperature, and with less impact to productivity for jobs with mixed sheet types. This is achieved by scheduling the job in such a way that heavy stock paper that usually require greater than normal fusing are always fully printed by the first marking engine. Note that if these sheets are duplex, they utilize the duplex capabilities of the first marking engine to print both sides of the sheet. Normal tandem job scheduling would have printed one side in the first marking engine and the other side in the second marking engine. These sheets are fused normally in the first marking engine, and then also pass through the fuser in the second marking engine, achieving the increase in fuser dwell time needed to fully fix the image.

The model of machine 202 and the at least one parameter of the sheet are periodically updated with information on the current states of marking engines 14, 16 by querying the respective marking engine CPUs 180, 182 and from data extracted from the print job. For example, the scheduling system may receive a print job of ten pages to be copied single sided, 50 times. The scheduling system 200 may determine, by querying model of machine 202, that both marking engines or print engines are available for printing and assign odd numbered pages to a first print engine 14 or first marking engine and even numbered pages to a second print engine 16 or second marking engine. During simplex printing, the printing system is controlled such that odd numbered pages are diverted from pathway 36 to pathway 34 via bell module 40, bypass the second print engine, crossover to path 36 at crossover 30, and enter the first print engine 14. Even numbered pages remain on pathway 36, are marked by second print engine 16, cross to pathway 34 via bell module 40, bypass first print engine, and arrive at a finisher in page number order with odd numbered pages.

The control system 184 communicates with the first and second print engines and other components of the printing system 100 to coordinate the printing of the print job, including the transportation of the print media to the print engines and the collation and assembly of print jobs output by the finisher according to a scheduled itinerary. In particular, the control system includes a processing component, such as a paper path controller 204, which controls the positions of decision gates 54, 56 according to whether the printing system is to operate in simplex mode or tandem duplex mode. Additionally, when print media is entering the crossover junction 70 from two directions, the control system 184 ensures that the entry of the sheets is staggered to avoid collisions. In particular, the control system 184 schedules a sheet 38 traveling in path 62 to completely pass through junction 70 in an inter-sheet gap between the training edge of a first sheet traveling in path 60 and a leading edge 90 of a successive sheet traveling in path 60. The control system 184 may operate on an open loop system in which the location of any sheet at any given time is predicted, based on the known operating speeds of the printing system components, such as print engines, drive systems, and the like. However, even relatively small variations in the weight of sheets, toner developed mass, and operating speeds of the printing system components may make it difficult to determine the arrival time at the crossover accurately. Thus, for high speed printing systems where sheets are arriving at the crossover at very short time intervals, an open loop system may not be adequate. The position of sheets may be sensed with one or more sensors 210, 212, such as optical sensors, located adjacent the conveyor system 20. In the illustrated embodiment, sensors 210, 212 are located in pathways 34, 36, upstream of decision gates 54, 56, although it is also contemplated that sensors may be located in the media path crossover 30 and/or elsewhere in the conveyor system. The sensors 210, 212 communicate sheet position information to the control system 184.

The control system 184 schedules the entry of the sheets into the crossover junction 70 in such a way as to avoid sheet collisions. For example, in simplex printing, sheets may enter the junction 70 alternately along pathways 50 and 52. If the control system 184 determines that a sheet may collide with a sheet traveling in the other pathway (e.g., based on information from the sensors 210, 212 and/or determined from known parameters), the paper path controller 204 may slow down or accelerate one of the sheets, for example by changing the rotation speed of rollers 110, 112 and/or rollers 114, 116. Other drive systems and print media processing units 12, 14, 16 in the printing system may also be controlled by the paper path controller 204 to change the velocity of the sheets so as to avoid collisions in the junction 70.

The various electronic processing components of the printing system, such as marking engine CPUs (180, 182) and control system 184, may be embodied in any suitable software or hardware. Moreover, the disclosed methods may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like.

Optionally, a user input device 206, such as a keyboard or touch screen, may be used by an operator of the printing system to communicate with the control system 184. The operator may input instructions which the control system 184 uses in selecting a printing mode, such as a tandem duplex mode or a simplex mode.

The printing system 100 is an illustrative example. In general, any number of print media sources, media handlers, marking engines, collators, finishers or other processing units can be connected together by a suitable print media conveyor configuration.

Figure 4:
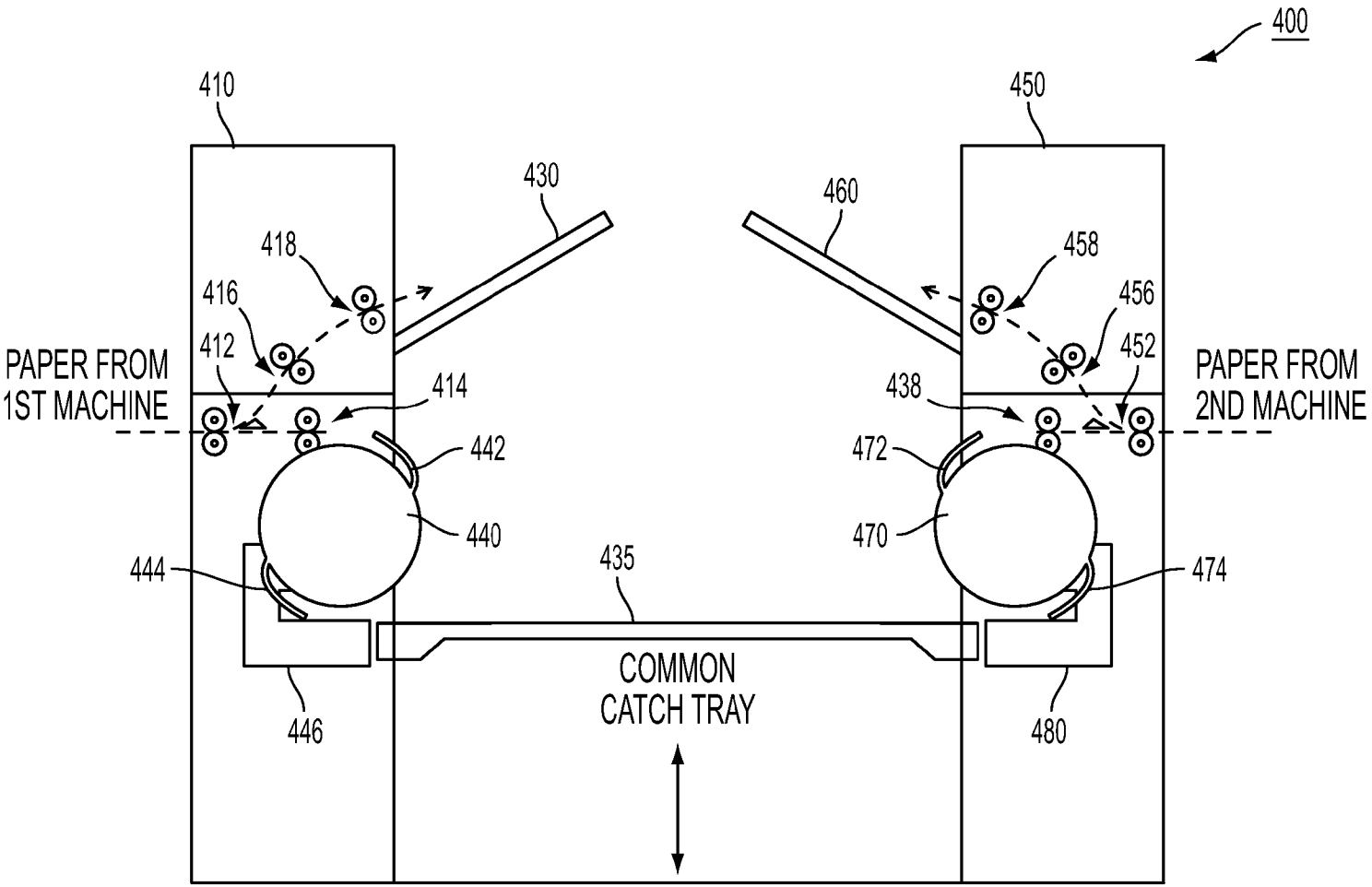
FIG. 4 is a schematic elevation view of a tandem printer system in accordance to an embodiment.

As shown in FIG. 4, finisher station 400 includes first and second finishers 410 and 450, respectively. Sheets conveyed in the direction from first printer 210 are directed nip 412 which conveys the sheets into first finisher 410 to be stapled as sets or forwarded onto bypass tray 440. Sheets that are not to be stapled are driven by nips 412, 416 and nip 418 onto bypass tray 440. If the sheets are to be stapled as sets, in finisher 410, they are driven by nips 412 and 414 into finger 442 or 444 of disk 440. Disk 440 is rotated in order to register the sheets in dual head stapler 446 where the sheets are stapled into a set. After stapling, disk 440 is rotated in a clockwise direction and allows the set of sheets to drop onto common catch tray 445. Imaged sheets from second printer conveyed in the direction of arrow enter nip 452 and are either conveyed into finisher 450 via nip 448 into either finger 472 or 474 of disk 470 that drives them into dual stapler head 480 to be stapled into sets or transported up and onto bypass tray 460 by the use of drive nips 452, 456 and nip 458. If the sheets are stapled into sets, they are released from fingers 472 or 474 of disk 470 onto common catch tray 445. Common catch tray 445 is a conventional tray with a movable platform that is controlled by springs or rotation of screws, etc. and adapted to reposition itself after a predetermined number of sets have been deposited thereon from finisher 410 and/or finisher 450. Sets from second finisher 450 are ejected alternately with sets ejected from first finisher 410. Second finisher 450 is rotated 180 degree with respect to standard positioning of first finisher 410, i.e., the inboard side of the finisher is facing outboard. It operates the same as first finisher 410. With second finisher being rotated 180 degree with respect to the positioning of first finisher 410, stapled sets are alternated from each finisher and sent to common catch tray 445. As the staples now alternate between diagonal corners, stapled sets are half as high as would be the case with both finishers positioned the same. The center positioned, dual finisher station 400 is user friendly since it eliminates bending over for stapled sets as the output in common tray 445 is basically waist high due to its positioning.

Figure 5:
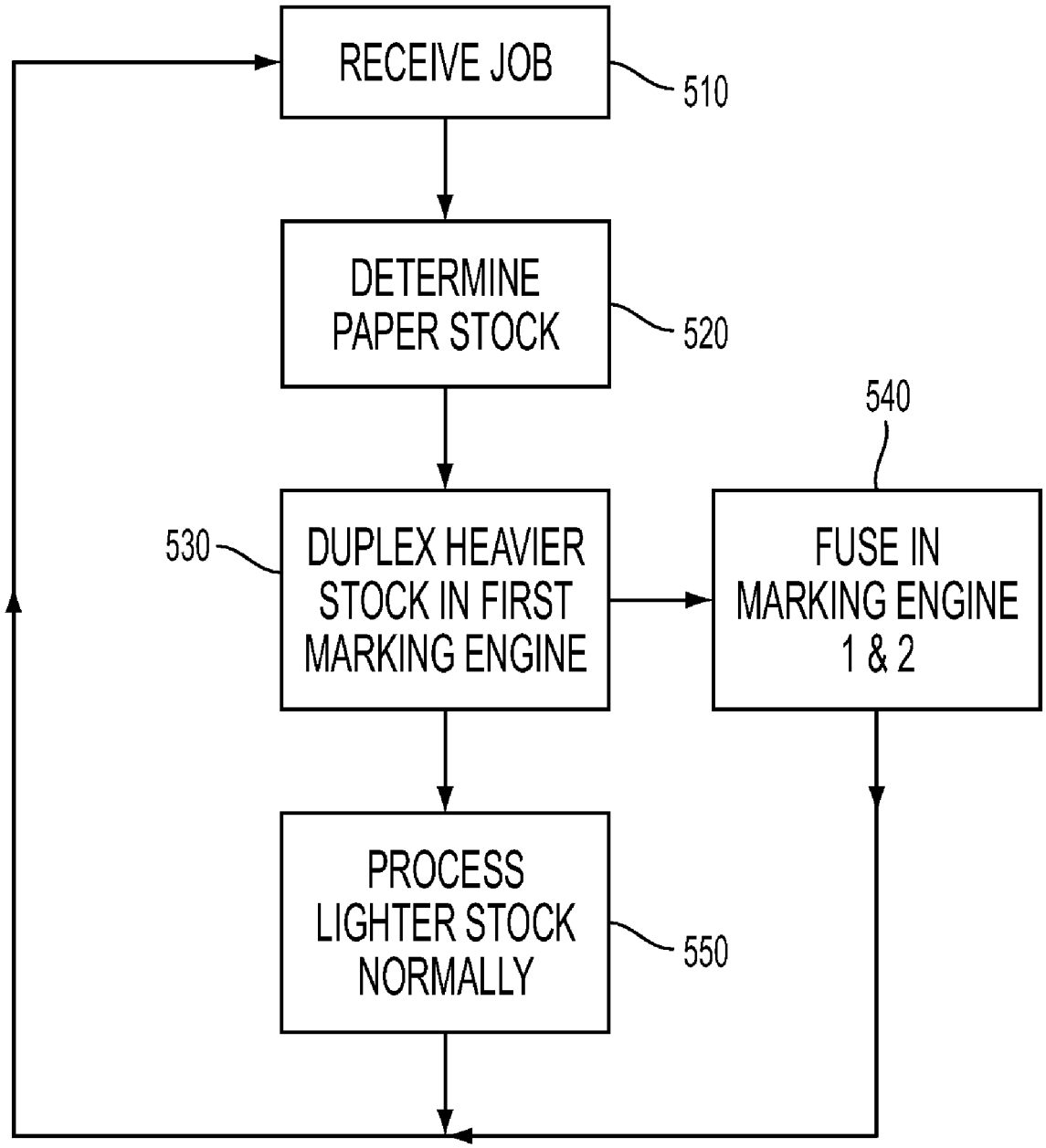
FIG. 5 illustrates a flowchart of a method for controlling the tandem printer system in accordance to an embodiment.

FIG. 5 illustrates a flowchart of a method for controlling the tandem printer system in accordance to an embodiment. In action 510, a print job or job specification is received or entered by an operator through user input 206. Jobs may be received with various combinations of parameters. These parameters are very useful in enabling the print system to deliver exactly the output desired. The jobs specification is processed by control system 184 and a schedule is determined in accordance to the received job specification. Alternatively, a print job can be electronically delivered to controller 184 via a wire or wireless connection by a remote device such as another print platform, a computer, and the like. For example, a network user operating word processing software running on a remote computer may select to print the word processing document on printing system 100, thus generating a print job, or an external scanner connected to the network may provide the print job in electronic form. It is also contemplated to deliver print jobs to the printing system 100 in other ways, such as via CD, DVD, optical disk, magnetic tape, flash memory, etc., or using a dedicated computer connected only to printing system 100. Control passes to action 520 for further processing.

In action 520, the received print job in action 510 is parsed to determine the paper stock or print media needed to complete the print job. All print media (i.e. paper) may be defined by a common set of parameters, with each print media being defined by specific values for each parameter in the set of parameters. That is, every type of print media has a type, a size, a color, a weight, etc, while each specific print media has specific values for the type, size, color, weight, etc. For example, the print media (A4 paper) has the following parameter values: type-plain; size-21.0 cm.times.29.7 cm; color-white; weight-90 gsm. Accordingly, the term parameter as used herein encompasses any type of characteristic, such as type, size, color, weight, and the like, by which print media may be identified. The print media can be group into distinct sets based on any of the above enumerated parameters. For example, paper exceeding a weight of greater than or equal to some arbitrary weight can be deemed as heavy stock paper or lighter stock paper if is below that predetermined weight.

In action 530, sheet that exceed a predetermined paper weight heavier stock) are schedule for printing at the first print engine. The scheduler or scheduling system in controller 184 schedules the received print job in such a way that sheets that require greater than normal fusing are always fully printed by the first print engine 14. Note that if these sheets are duplex, they utilize the duplex capabilities of the first print engine to print both sides of the sheet. These sheets are fused normally in the first print engine, and then also pass through the fuser in the second print engine 16. The pass through the second fuser provides the increase in fuser dwell time needed to fully fix the image. Paper stock that does not exceed a predetermined paper weight (lighter stock) is processed normally and control passes to action 550.

In action 550, the print job is schedule normally and both print engines are utilized in performing printing duties. In normal tandem scheduling, a first side is printed in the first print engine and a second side is printed in the second print engine for the body stock. For example, a print job containing front and back 280 gsm index covers with 50 prints of nominal 90 gsm baseline paper is programmed by the user. The tandem print system software recognizes (new operation) this as a job that could schedule the covers heavy stock) to be processed by print engine one and the baseline paper sheets processed normally where side one by print engine one, and side two by print engine two. This enables all 90 gsm sheets to be printed at full system productivity, and only influences productivity when printing the cover pages. The scheduler can program the sequence of sheets so as to minimize or eliminate skipped pitches when printing such a job, using techniques such as electronic inversion.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A tandem printing system, comprising:

a first marking engine comprising a sheet feeder, a sheet transport, a first device for printing images onto sheets supplied from said sheet transport by said sheet feeder, a fuser for fusing said images placed onto the sheets, wherein the first marking engine includes a marking path and a duplex path whereby a plurality of sheets move through an entrance path, said marking path and said duplex path in a first order sequence, and then selected sheets move back to said entrance path wherein said selected sheets are inverted and moved again through said marking path in a second order sequence;

a second marking engine comprising a second sheet feeder, a second device for printing images onto sheets supplied from said sheet transport, and a second fuser for fusing said images placed onto the sheets; and a controller, the controller being configured to process at least one print job in the first and second marking engines, the print job including printing on at least one sheet having a first weight, and printing on at least one sheet having a second weight, wherein the controller schedules the print job whereby the printing on the at least one sheet having the first weight comprises printing an image on the sheet having the first weight at the first marking engine, and fusing the sheet having the first weight at the first marking engine and the second marking engine.

2. The tandem printing system of claim 1, the controller being configured to print on all sheets that exceed a predetermined paper weight at the first marking engine.

3. The tandem printing system of claim 1, wherein the controller causes all sheets that exceed a predetermined paper weight to be fused at both the first and second marking engines.

4. The tandem printing system of claim 1, wherein the controller causes all sheets that do not exceed a predetermined paper weight to be processed by both the first and second marking engines.

5. A method for scheduling a print job in accordance with a job specification in a tandem print system, the method comprising:

receiving the job specification for processing at the tandem print system, wherein the job specification includes at least one sheet parameter; and producing a command stream from the job specification to produce the job in the tandem print system;

wherein the tandem print system comprises a first marking engine having a sheet feeder, a sheet transport, a first device for printing images onto sheets supplied from said sheet transport by said sheet feeder, a fuser for fusing said images placed onto the sheets, wherein the first marking engine includes a marking path and a duplex path whereby a plurality of sheets move through an entrance path, said marking path and said duplex path in a first order sequence, and then selected sheets move back to said entrance path wherein said selected sheets are inverted and moved again through said marking path in a second order sequence;

wherein the tandem print system comprises a second marking engine having a second sheet feeder, a second device for printing images onto sheets supplied from said sheet transport, and a second fuser for fusing said images placed onto the sheets;

wherein the at least one sheet parameter includes paper weight, and wherein the command stream causes all sheets that exceed a predetermined paper weight to be fused at both the first and a second marking engines of the tandem print system.

6. The method of claim 5, wherein the command stream causes all sheets that exceed a predetermined paper weight to be printed on the first marking engine of the tandem print system.

7. The method of claim 5, wherein the command stream causes all sheets that do not exceed a predetermined paper weight to be processed by both the first and second marking engines of the tandem print system.

8. A printing system comprising:

first and second marking devices for applying images to print media;

a first fusing module associated with the first marking device for applying a primary fusing treatment to the images applied to the print media by the first marking device;

a second fusing module which receives printed media from the first and second marking devices, the secondary fusing module including a fusing device which applies a fusing treatment to the images applied to the printed media; and printing controller having a scheduler for processing print jobs in the first and second marking devices based on fusing requirements, wherein the fusing requirements based on at least a paper weight of the print media, wherein the scheduler causes all print media that exceed a predetermined paper weight to be printed on the first marking device.

9. The printing system of claim 8, wherein the scheduler causes all print media that exceed a predetermined paper weight to be fused at the first and the second fusing module.

10. The printing system of claim 8, wherein the scheduler causes all sheets that do not exceed a predetermined paper weight to be processed by both the first and second marking devices.

11. The printing system of claim 8, wherein the first marking device and the second marking device are operatively connected to each other for printing images onto print media from a common electronic print job stream.

12. The printing system of claim 11, wherein the first and second fusing module each include a heater for heating fused images from the first and second marking devices to achieve printed images having an appearance level which is within a predefined range.

13. The printing system of claim 12, wherein the printing controller controls operation parameters of the first and second primary fusing modules.

14. The printing system of claim 13, wherein the marking engine controller routes printed media from the first marking device to the secondary fusing devices.

* * * * *